US005992023A

United States Patent [19]

Sederberg et al.

[11] Patent Number: 5,992,023

[45] Date of Patent: Nov. 30, 1999

[54] SHEAR WITH INTERCHANGEABLE WEAR PARTS

[75] Inventors: Clayton Sederberg; Daniel Jacobson, both of Duluth, Minn.

[73] Assignee: The Stanley Works, New Britain, Conn.

[21] Appl. No.: 09/127,147

[22] Filed: Jul. 31, 1998

[51] Int. Cl.[6] ..... B02C 1/06

[52] U.S. Cl. ..... 30/134; 241/101.73

[58] Field of Search ..... 30/134, 228; 72/144, 72/326, 330; 83/609, 928; 144/34.5; 241/101.73, 266, 300

[56] References Cited

U.S. PATENT DOCUMENTS

| | | | |
|---|---|---|---|
| 4,519,135 | 5/1985 | LaBounty | 30/134 |
| 4,669,187 | 6/1987 | Pardoe | 30/134 |
| 4,776,093 | 10/1988 | Gross | 30/134 |
| 5,060,378 | 10/1991 | LaBounty et al. . | |
| 5,146,683 | 9/1992 | Morikawa . | |
| 5,359,775 | 11/1994 | Morikawa et al. | 30/134 |
| 5,671,892 | 9/1997 | Morikawa et al. | 241/101.73 |
| 5,860,214 | 1/1999 | Morikawa et al. | 30/134 |
| 5,894,666 | 4/1999 | Hrusch | 30/134 |

OTHER PUBLICATIONS

Sketch of blades in Teledyne Design (Exhibit 13).
Maintenance Manual LaBounty MDS Shear (Exhibit 14) Skidsteer Loader).
Photographs LaBounty MSD Shear (Exhibit 15).
Literature Verachtert Shears (Exhibit 16).
Literature Verachtert Shears (Exhibit 17).
Literature Verachtert Shears (Exhibit 18).
Photographs Verachtert Shears (Exhibit 19).
Literature Allied Gator Shear (Exhibit 20).
Photographs Teledyne Shear (Exhibit 25).
Photographs LaBounty MSD–30 (Exhibit 26).
Brochure, LaBounty Universal Processor Shear Jaws Attachment.
Photographs and literature—Teledyne Shear.
Literature Veratech Shear Attachments.
Literature, Iron Ax Shears.
Photographs, Komatsu (Oyodo) Shear.
Product Drawing ORT Oberlander Shear.

*Primary Examiner*—Hwei-Siu Payer

[57] ABSTRACT

A demolition shear has a pair of pivotably movable elongated jaws each having a pivot portion and an elongated jaw portion extending therefrom. The lower jaw portion has a cutter side wall, a guide side wall and an outer end wall, and the cutter side wall has an upper working surface with a generally V-shaped configuration, and a recess providing a blade seating shoulder extending parallel to the upper surface. The end shoulder at the proximal end intersects at an obtuse angle with the blade seating shoulder, and defines a reference plane. Seated on the shoulder are abutting; elongated rhimboidal lower cutter blades with end faces extending parallel to the reference plane. The outer end wall has an inner surface portion has a blade seating shoulder on its inner surface on which is seated a cross cutter blade. The guide side wall has a recess adjacent the outer end wall which provides a blade seating shoulder on which is seated a guide blade. The distal end surfaces of the guide and distal cutter blades extend parallel to the reference plane and bear firmly against the cross cutter blade which also lies in parallel plane. The upper jaw has an invention V-shape pivot portion and a jaw portion extending therefrom with a cutter side surface adjacent the cutter side surface of the lower jaw and a guide side surface. Its cutter side surface has a recess providing a blade seating shoulder on which is seated a pair of abutting elongated rhomboidal upper cutter blades.

15 Claims, 13 Drawing Sheets

SHEAR WITH INTERCHANGEABLE WEAR PARTS

BACKGROUND OF THE INVENTION

The present invention relates to demolition shears, and, more particularly, to such shears in which there are provided replaceable blade elements.

Demolition shears conventionally employ relatively movable upper and lower jaws which are structured and configured to cut metallic and other elements between the relatively movable jaws. As is well known, such shears generally cut along one side of the relatively movable jaws while the workpiece is supported on a guide surface extending along the other side of the jaws. In addition, many shears have a "tooth" or cutting tip at the forward end of the upper jaw which is designed to pierce the workpiece. These shears are used to cut large metallic members into short pieces which can be more easily handled and transported.

The lower jaw of a demolition shear has a guide mechanism to support the narrower upper jaw as it moves within the recess of the lower jaw. The guide mechanism consists of a blade insert on the side of the jaw opposite from that mounting the main cutter blades. This blade insert is bolted into a blade seat which is exposed and requires frequent dressing with weld metal.

As is conventional, the demolition shear is an attachment which is mounted on the boom structure of a hydraulically powered construction machine and has a hydraulic cylinder attached to one or both jaws to move the jaws relative to each other.

Because of the hardness and/or abrasiveness of various workpieces which are being processed, the material of the jaws is abraded and otherwise worn away over a period of time. The jaws are large and heavy and are generally fabricated as cast structures or welded from metal plate. Although weld metal may be utilized to rebuild the surfaces which are being worn, commonly hardened steel cutter blades are employed along the several working surfaces of the upper and lower jaws to provide wear resistance since they will provide the principal working surface and reduce the wear on the surrounding structure of the jaws upon which they are mounted. Desirably, these cutter blades are removably mounted on the jaws so that they can be replaced as they wear.

Desirably, the demolition shear usually has at least one jaw which is V-shaped to facilitate retention of the material being processed. When utilizing conventional rectangular cutter blades, small triangular portions of the jaws at the apex of the V-shape are exposed between the adjacent ends of inserts are exposed to wear and require frequent dressing with weld metal.

Accordingly, it is an object of the present invention to provide a novel demolition shears utilizing V-shaped jaws and cutter blades which protect the working surface of the jaws and which are readily replaceable.

It is also an object to provide such demolition shear in which the cutter blades may be rotated and/or inverted to utilize multiple edges thereof.

Another object is to provide such a demolition shear in which the cutter blades of both jaws may be readily interchanged to enable optimum usage thereof.

Still another object is to provide such a demolition shear in which the cutter and guide blades may be quickly replaced or reoriented upon the jaws.

It is a further object of the present invention to provide such a demolition shear utilizing a guide blade and cross blade assembly to protect the outer end of the lower jaw and which are readily replaceable.

SUMMARY OF THE INVENTION

It has now been found that the foregoing and related objects may be readily attained in a demolition shear having a pair of elongated jaws with opposing faces between which workpieces are received, at least one of the jaws being movable relative to the other about a pivot. The lower jaw has a pivot portion and an elongated jaw portion extending therefrom with a cutter side wall, a guide side wall, and an outer end wall collectively defining with the pivot portion a generally rectangular recess. The cutter side wall has an upper working surface with a generally V-shaped configuration provided by a proximal section adjacent the pivot portion and a distal section extending to the outer end wall, and the two sections intersect at an obtuse angle.

The inner face of the cutter side wall has a recess formed therealong providing a blade seating shoulder extending longitudinally thereof parallel to the upper surface of the side wall. The recess has a proximal end shoulder adjacent the pivot portion intersecting at an obtuse included angle with the blade seating shoulder of the proximal section, and this end shoulder defines a specified reference plane.

Seated on the blade seating shoulder is a pair of elongated lower cutter blades each having a parallelogram or rhomboidal configuration with the same included angles. The cutter blades have end faces extending in planes parallel to the specified reference plane of the end shoulder with their adjacent end faces abutting closely and a top face extending substantially parallel to the upper surface of the cutter side wall. Releasable fasteners secure the lower cutter blades to the cutter side wall, and the cutter blades are reversible to enable usage of all elongated edges thereof.

The outer end wall has an inner surface portion extending in a plane parallel to the specified reference plane and a blade seating shoulder on the inner surface portion. A cross cutter blade is seated on the blade seating shoulder of the outer end wall, and its top surface extends substantially parallel to the upper surface of the outer end wall. The cutter blade on the distal portion of the cutter side wall has its distal end surface bearing against the side surface of the cross cutter blade which is reversible to enable usage of plural edges thereof.

The inner surface of the guide side wall has a recess formed therein adjacent the outer end wall, and the recess provides a blade seating shoulder on which is seated a guide blade. Its distal end surface is parallel to the specified reference plane and bears firmly against the side surface of the cross cutter blade, and its top surface extends substantially parallel to the adjacent upper surface of the guide wall. The guide blade is reversible to enable usage of plural edges thereof, and releasable fasteners secure the guide blade to the guide side wall.

The upper jaw has a pivot portion and a jaw portion extending therefrom with a cutter side surface adjacent the cutter side surface of the lower jaw and a guide side surface. The lower working surface of the jaw portion is of inverted V-shaped configuration provided by a proximal section adjacent the pivot portion and a distal section spaced therefrom which intersect at an obtuse angle. The cutter side surface of the upper jaw portion has a recess formed therein providing a blade seating shoulder extending longitudinally thereof. A pair of elongated upper cutter blades bears against the blade seating shoulder, and the blades have a lower face extending parallel to the adjacent lower working surface of the upper jaw portion and adjacent end faces which abut closely. Releasable fasteners secure the upper cutter blades to the upper jaw, and the upper cutter blades are reversible to enable usage of all elongated edges thereof. The upper jaw portion is dimensioned cooperatively with the recess of the lower jaw portion so as to be movable thereinto. The upper and lower cutter blades adjacent the pivot portions are the primary blades and the upper and lower cutter blades adjacent the outer end wall are the secondary blades.

The recess of the upper jaw has a proximal end shoulder which intersects the longitudinal seating shoulder at an included obtuse angle corresponding to that of the intersection of the proximal end and longitudinal shoulders of the lower jaw, and the upper cutter blades have a parallelogram or rhomboidal configuration corresponding to that of the lower cutter blades.

In one embodiment, the upper cutter blades are egual in dimension to the lower cutter blades, and the lower and upper cutter blades are reversible and may be interchanged to enable all four longitudinal edges thereof to be employed as the cutting edges. In another embodiment, the upper primary and secondary cutter blades are of the same dimension and in the lower primary and secondary cutter blades are of the same dimension but differ in length from the upper blades, whereby the cutter blades of each jaw may be interchanged. In still another embodiment, the primary upper and secondary lower cutter blades are of the same dimensions and the secondary upper and primary lower cutter blades are of the same dimensions but of different length, than the primary upper and secondary lower cutter blades, whereby the primary cutter blade of one jaw may be interchanged with the secondary cutter blade of the other cutter jaw.

Preferably the guide blade has a multiplicity of adjacent edge surfaces intersecting at an included angle substantially equal to the included angle between the blade seating shoulder of the lower cutter jaw and the proximal end shoulder. One of the edge surfaces extends parallel to the upper surface of the guide side wall, and the distal edge surface bears against the side surface of the cross cutter blade. Preferably, the guide blade is of hexagonal configuration to enable the guide blade to be rotated and inverted to use a multiplicity of the edges thereof for contact with workpieces and support of the upper jaw.

In one embodiment, the secondary upper cutter blade extends to the distal end of the upper jaw. In another embodiment, the secondary cutter blade of the upper jaw portion is spaced from the distal end of the upper jaw portion and an end cutter member is secured to the lower surface of the distal end portion of the upper jaw portion to provide a cutting edge surface at the distal end cooperating with the cross cutter blade.

In one embodiment, the cross cutter blade has a slot therein and the shoulder on the outer end wall seats in the slot. This shoulder on the outer end wall is provided by an inwardly projecting boss dimensioned to seat in the slot of the cross cutter blade.

Desirably the releasable fasteners have heads and shanks, and the heads are seated in recesses in the jaw portions and the shanks engage the cutter blades. Preferably, the lower and upper cutter blades have threaded apertures therein in which the threaded shanks of the fasteners are threadably engaged.

BRIEF DESCRIPTION OF THE ATTACHED DRAWINGS

DETAILED DESCRIPTION OF THE PREFERRED EMBODIMENT

Figure 1:
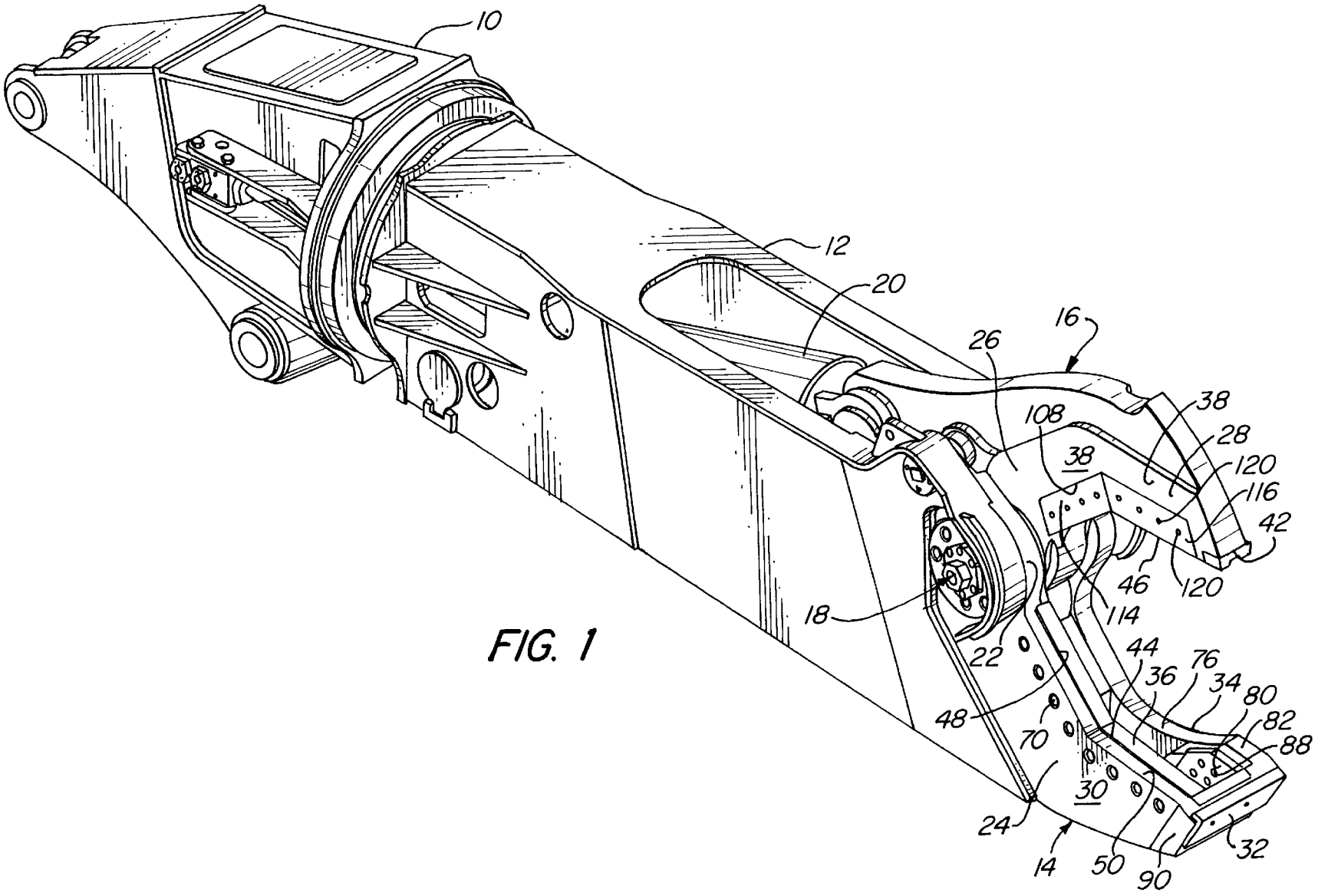
FIG. 1 is a perspective view of a demolition shear embodying the present invention which employs a rotatable mounting element and in which the movable upper jaw is in a raised position.
Figures 2, 2A:
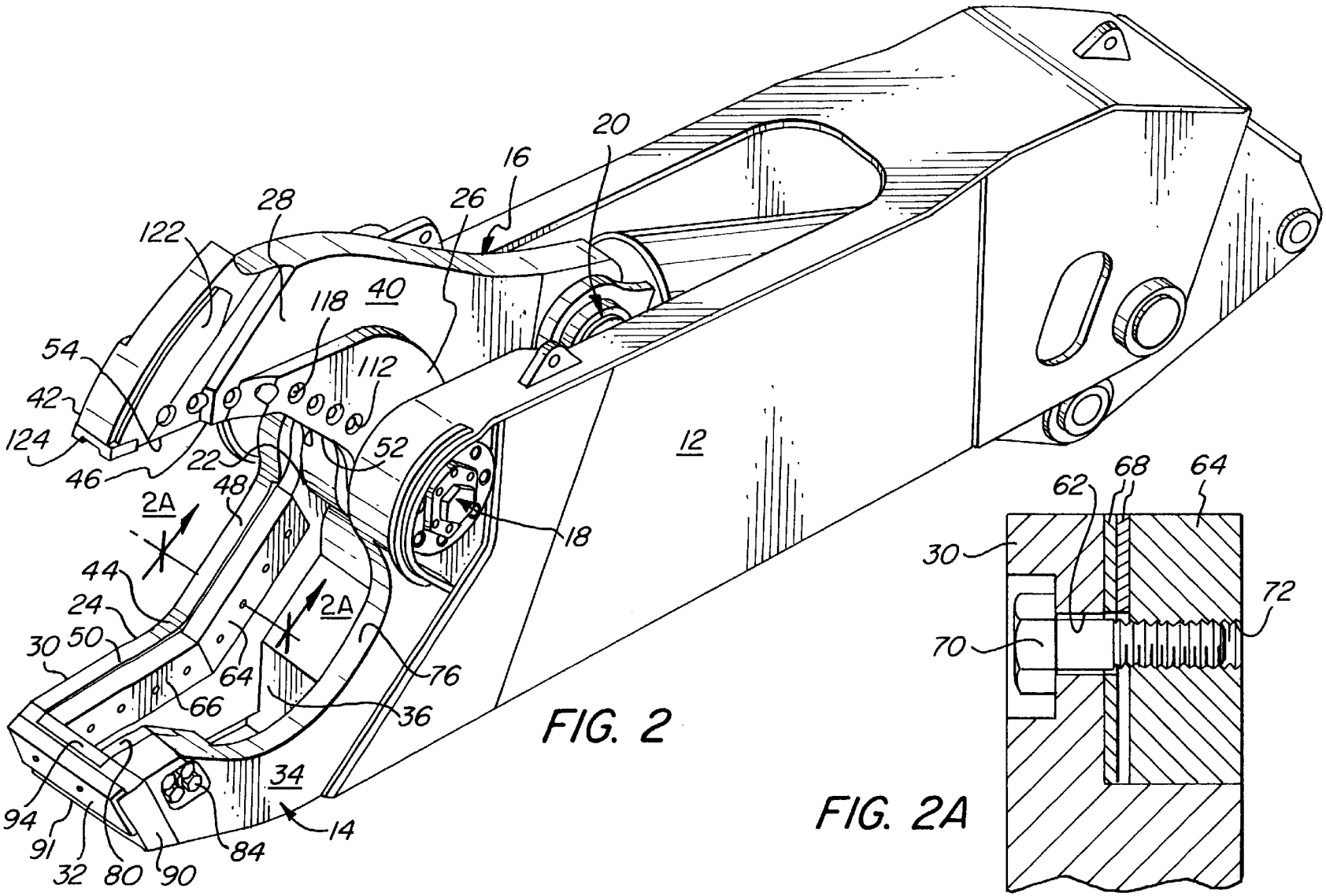
FIG. 2 is a perspective view of an embodiment of the shear which is non-rotatable but which incorports the novel shear components.
FIG. 2A is an enlarged sectional view of the cutter jaw and blade assembly along the line 2A—2A of FIG. 2.

Turning first to FIGS. 1 and 2, therein illustrated is a shear embodying the present invention. In FIG. 1, the mounting portion 10 which can be secured to a construction vehicle (not shown) includes a rotatable element upon which the body of the shear is rotatably supported. The embodiment of FIG. 2 does not incorporate a rotatable element and is fixedly oriented on the construction vehicle. The shear itself is comprised of the body 12, the lower jaw generally designated by the numeral 14, and the upper jaw generally designated by the numeral 16. The pivot assembly generally designated by the numeral 18 pivotally supports the upper jaw 16 on the body 12 and lower jaw 14 for pivotal movement relative thereto. In this embodiment, only the upper jaw 16 is movable, and this movement is effected by the hydraulic cylinder 20 which is secured at one end to the body 12 and at the other end to the upper jaw 16.

The lower jaw 14 has a pivot portion 22 and a jaw portion 24 extending forwardly therefrom. The upper jaw 16 also has a pivot portion 26 and a jaw portion 28 extending forwardly therefrom.

The lower jaw 14 has a cutter side wall 30, an outer end wall 32 and a guide side wall 34 defining an upwardly opening recess 36 in cooperation with the pivot portion 22.

Figure 3:
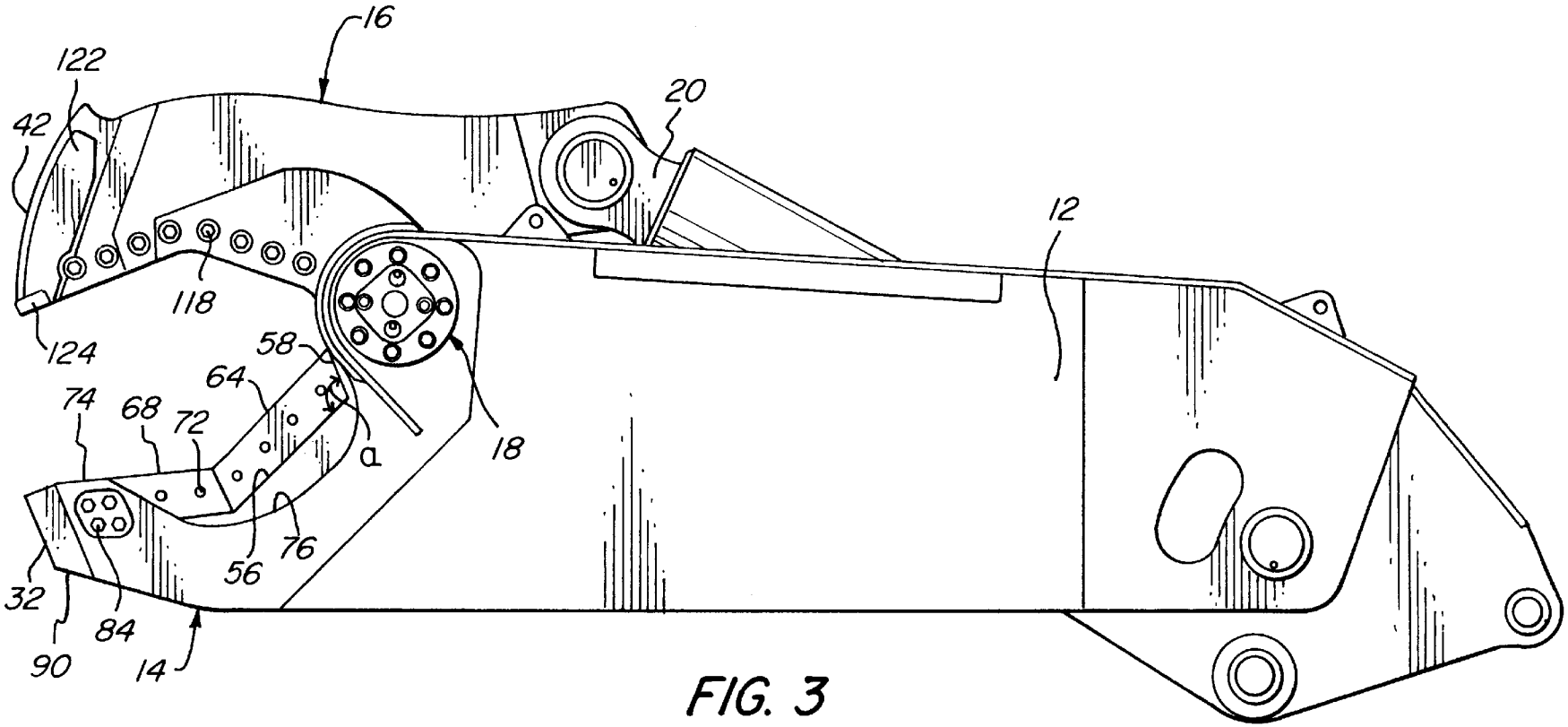
FIG. 3 is a side elevational view of the shear as seen in FIG. 2.

The upper jaw 16 has a cutter side surface 38, a guide side surface 40 and a nose portion 42 at its outer end. As seen, the cutter side wall 30 has a V-shaped top surface 44 with a proximal section 48 adjacent the pivot portion 22 and a distal section 50 adjacent the outer end wall 32. Similarly, the upper jaw 16 has a V-shaped lower surface 46 with a proximal section 52 and a distal section 54. As will be readily appreciated, the upper jaw 16 is configured and dimensioned so that it will fit snugly into the recess 36 of the lower jaw 14 as is best seen in FIG. 3.

Figure 4:
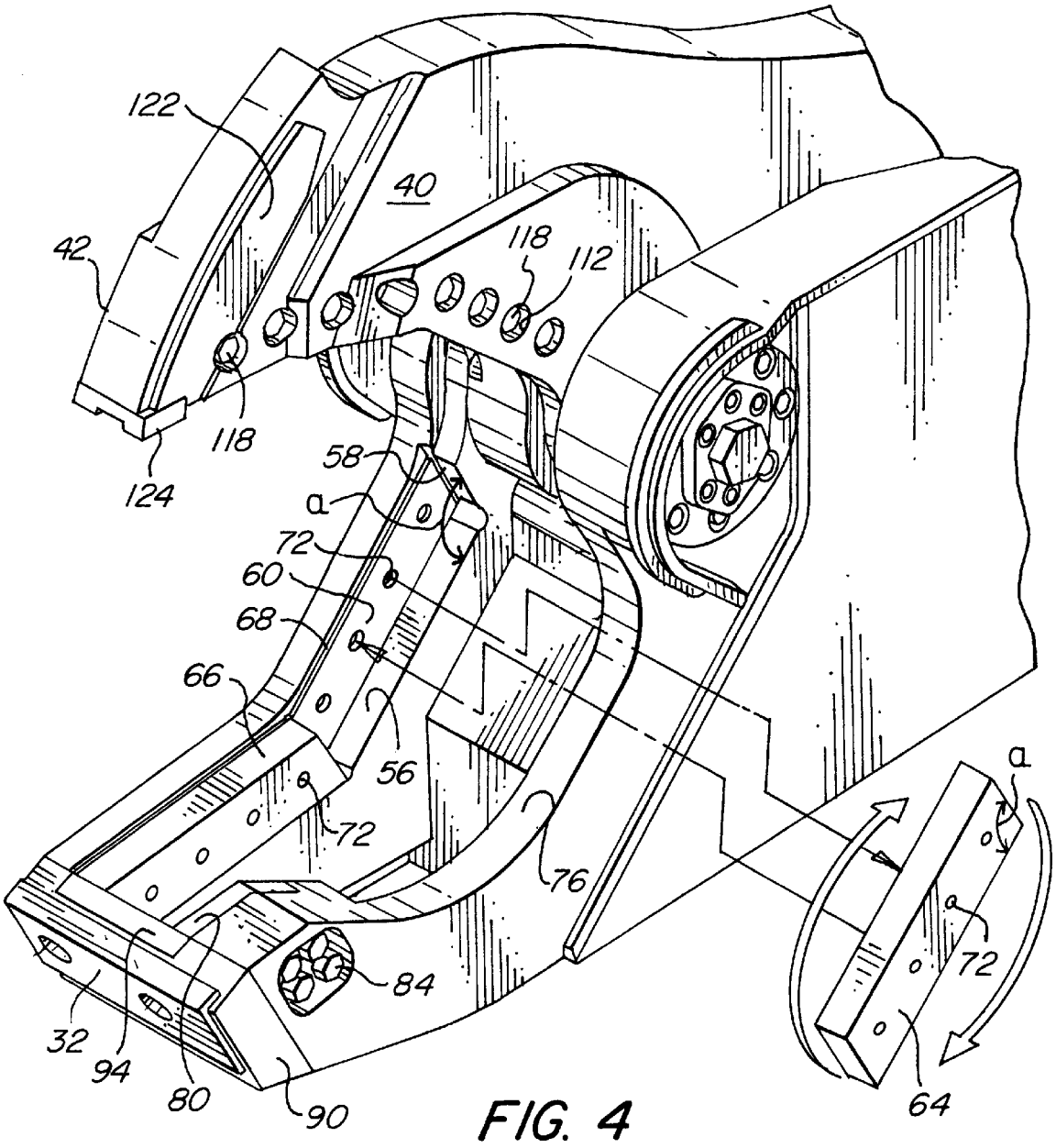
FIG. 4 is an enlarged fragmentary view of the shear with the primary lower cutter blade removed, and diagrammatically illustrating by the arrows that it is reversible.
Figure 8:
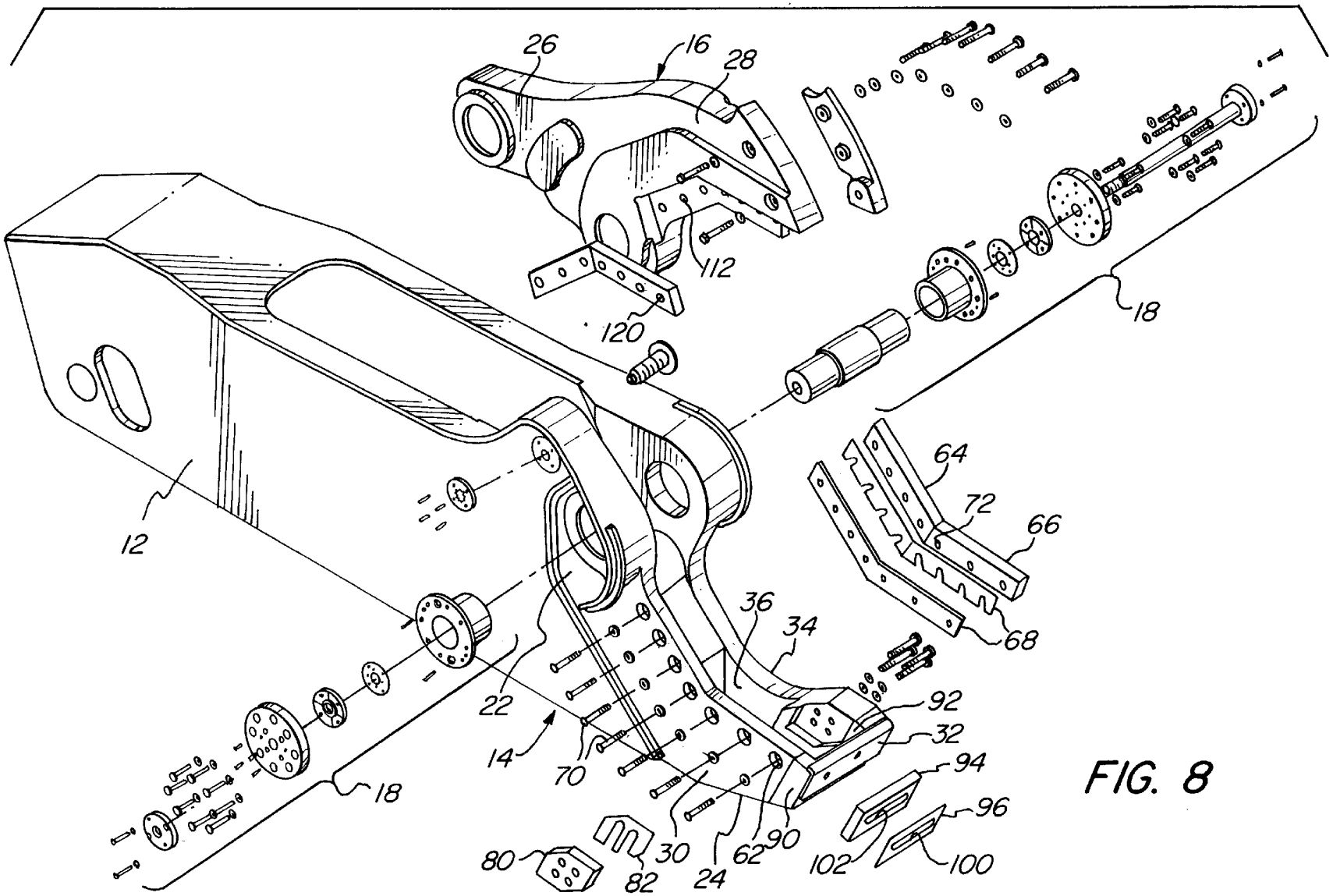
FIG. 8 is an exploded view of the upper and lower jaws of the shear and also illustrating an alternate embodiment for the nose end of the upper jaw.

As best seen in FIG. 4, the inner surface of the cutter side wall 30 is formed with an elongated, upwardly opening recess 60 providing a V-shaped longitudinal shoulder 56 and proximal end shoulder 58. As seen in FIGS. 1 and 4, apertures 62 extend through the cutter side wall 30. Seated on the longitudinal shoulder 56 are the primary cutter blade 64 and the secondary cutter blade 66. The proximal end of the primary cutter blade 64 seats snugly against the proximal end shoulder 58, and the adjacent ends of the cutter blades 64, 66 abut over substantially their entire surfaces. Also seen in FIGS. 4 and 8 are shims 68 disposed between the cutter blades 64, 66 and the inner side surface of the cutter side wall 30. As seen in FIGS. 1 and 4, the fasteners 70 extend through the apertures 62 in the cutter side wall 30 and through the shims 68, and they threadably engage in apertures 72 in the cutter blades 64, 66.

As best seen in FIG. 4, the proximal end shoulder 58 intersects the plane of the proximal section of the longitudinal shoulder 56 at an obtuse angle i, and the plane of the proximal end shoulder 58 is a specified reference plane which various other elements of the structure will parallel. As it may also be seen in FIG. 4, the cutter blade 64 is configured as a parallelogram or rhomboidal with an obtuse angle a at diagonal corners and complimentary acute angles at the opposite corners. This configuration for the cutter blade 64 is repeated in the configuration of the cutter blade 66 which is dimensionally equal thereto in the illustrated embodiment.

As seen in FIGS. 1–6, the guide side wall 34 has a distal end portion having a top surface 74 lying in the same plane as the upper surface of the distal section 50 of the cutter side wall 30. Rearwardly of this end portion is a concave recess 76 which extends to the pivot portion 22. Formed on the inner of the guide side wall 34 adjacent the outer end is a polygonal seating recess 78 in which are seated the polygonal guide blade 80 and its shim 82. Fasteners 84 extend through apertures 86 in the guide side wall 34 and threadably seat in the apertures 88 formed in the guide blade 80.

The outer end wall 32 is provided by a cross plate or member 90 which is welded to the ends of the cutter side wall 30 and guide side wall 34. The inner surface of the cross member 90 is formed with a recess 92 in which is seated the cross cutter blade 94 and its shim 96. Secured to the outer surface of the cross member 90 is an inverted L-shaped wear plate 91.

As is indicated in the several views, the outer end wall 32 and its several components, including the recess 92, extend in planes parallel to the reference plane defined by the proximal end shoulder 58. The adjacent distal end surfaces of the guide blade 80 and secondary cutter blade 66 also lie in planes parallel to the plane of the proximal end shoulder 58 and abut tightly against the adjacent surface of the cross cutter blade 94.

Figure 6:
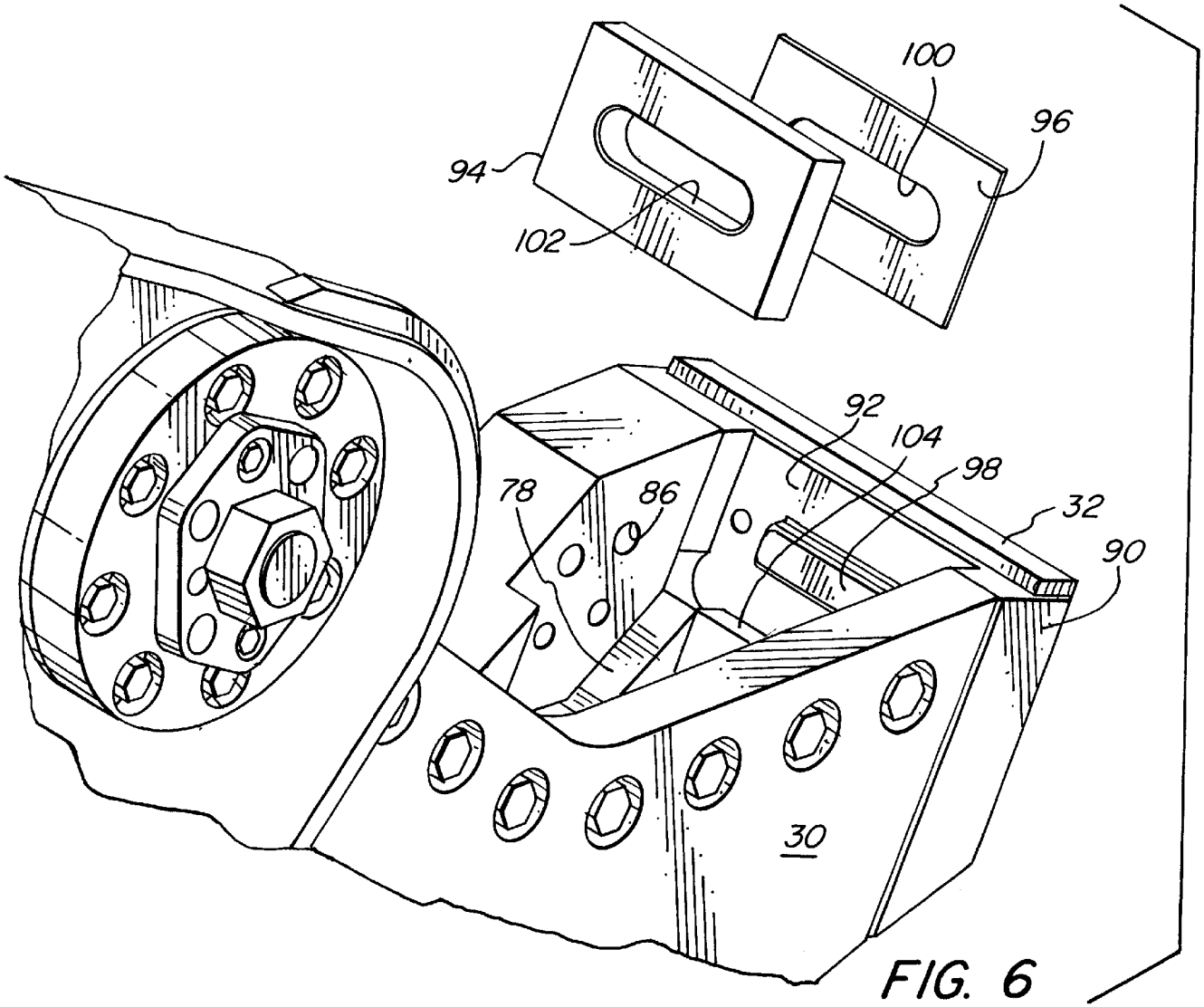
FIG. 6 is a fragmentary perspective view of the lower jaw portion with the several blades removed but illustrating thereabove the cross cutter blade and its shim.
Figure 7:
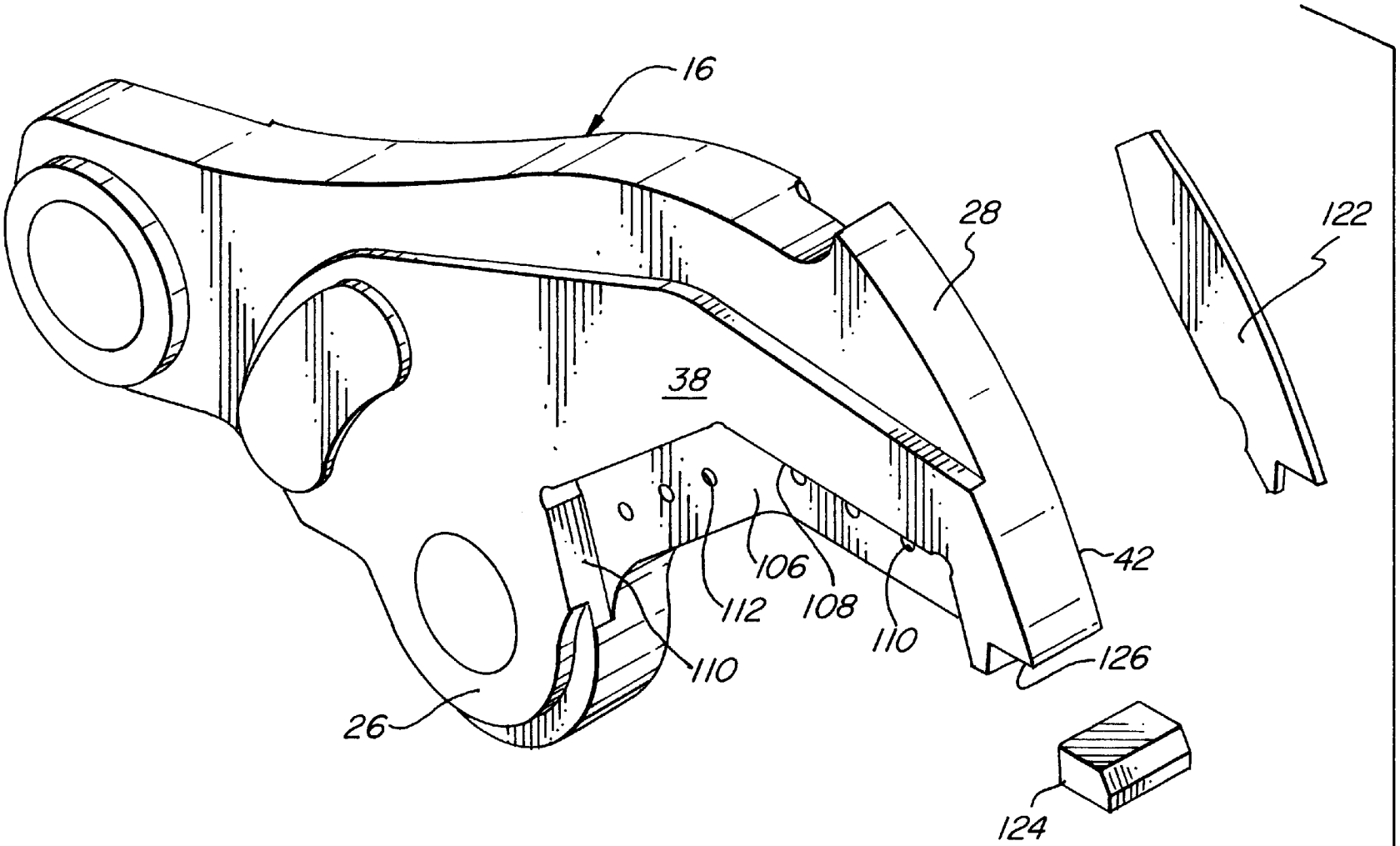
FIG. 7 is a perspective view of the upper jaw with the cutter blades removed showing the wear plate and nose blade prior to assembly therewith.

As seen in FIG. 6, a rectangular boss 98 is formed on the inner surface of the cross member 90 intermediate the depth of the recess 92, and the shim 96 and cross cutter blade 94 have cooperating apertures 100,102 formed therein so as to seat firmly on the boss 98 as well as against the shoulders 104 bounding the recess 92. By the combination of the recess 92, the boss 98, the abutment of the guide blade 80 and secondary cutter blade 66 against their surface, the cross cutter blade 94 is firmly positioned.

Turning next in detail to the upper jaw 16 as seen in FIGS. 1–7, the cutter side surface 38 has a downwardly opening recess 106 providing a longitudinally extending inverted V-shaped shoulder 108 with a proximal end shoulder 110. The included angle at the intersection of the shoulders 108,110 is obtuse and corresponds to the included angle between the proximal end shoulder 58 and longitudinal shoulder 56 of the lower jaw 14.

Seated on the shoulder 108 are the primary cutter blade 114 and the secondary cutter blade 116 which have the same parallelogram or romboidal configuration as the lower cutter blades 64, 66. Their end surfaces lie in planes parallel to the plane of the proximal end shoulder 108 of the upper jaw 16 and the abutting ends are in substantially full surface contact. The blades 114, 116 are secured to the upper jaw 16 by fasteners 118 which extend through apertures 112 in the upper jaw 16 and threadably seat in the apertures 120 of the cutter blades 114, 116.

In this embodiment, the recess 106 terminates inwardly from the distal end of the upper jaw 16 and has a distal end shoulder 111 lying in plane parallel to the plane of the proximal end shoulder 58 of the lower jaw 14 and the proximal end shoulder 110 of the upper jaw 16. The outer end of the upper jaw 16 provides a notch 126 of an inverted generally L-shaped configuration. This seats the nose blade 124 which is welded therein. Extending along the guide side surface 40 of the outer end portion of the upper jaw 16 is an elongated wear plate 122 which is also welded to the upper jaw 16.

Figure 5:
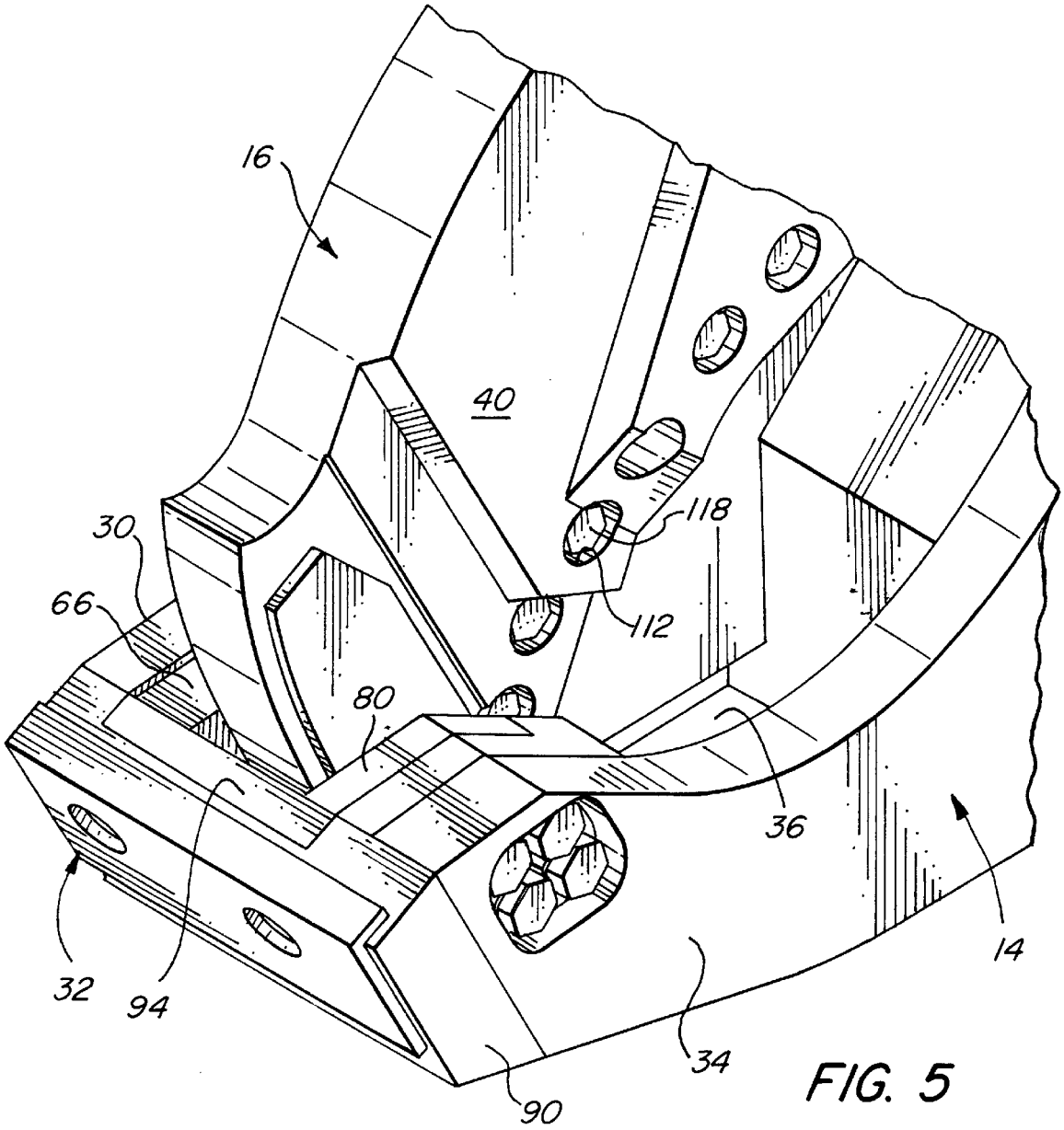
FIG. 5 is a further enlarged fragmentary view of the shear with the upper jaw moved downwardly into the recess of the lower jaw.

In operation of the shear, the upper jaw 16 is moved by the hydraulic cylinder 20 downwardly towards the lower jaw 14. A workpiece (not shown) tends to be centered in the area of the apex of the V-shaped working surfaces and arcuate recess 76. As the jaw 16 moves downwardly, it applies substantial compressive force to the workpiece and ultimately shearing take place as the upper cutter blades 114,116 move towards the lower cutter blades 64,66. The guide blade 80 provides guidance for the wear plate 122 to minimize lateral movement of the upper jaw 16 as it moves into the recess 36. Generally, the nose blade 124 will cooperate with the cross cutter blade 94 to pierce any workpiece that extends between them and the nose blade 124 can move closely by the cross cutter blade 94 as seen in FIG. 5.

Figure 9:
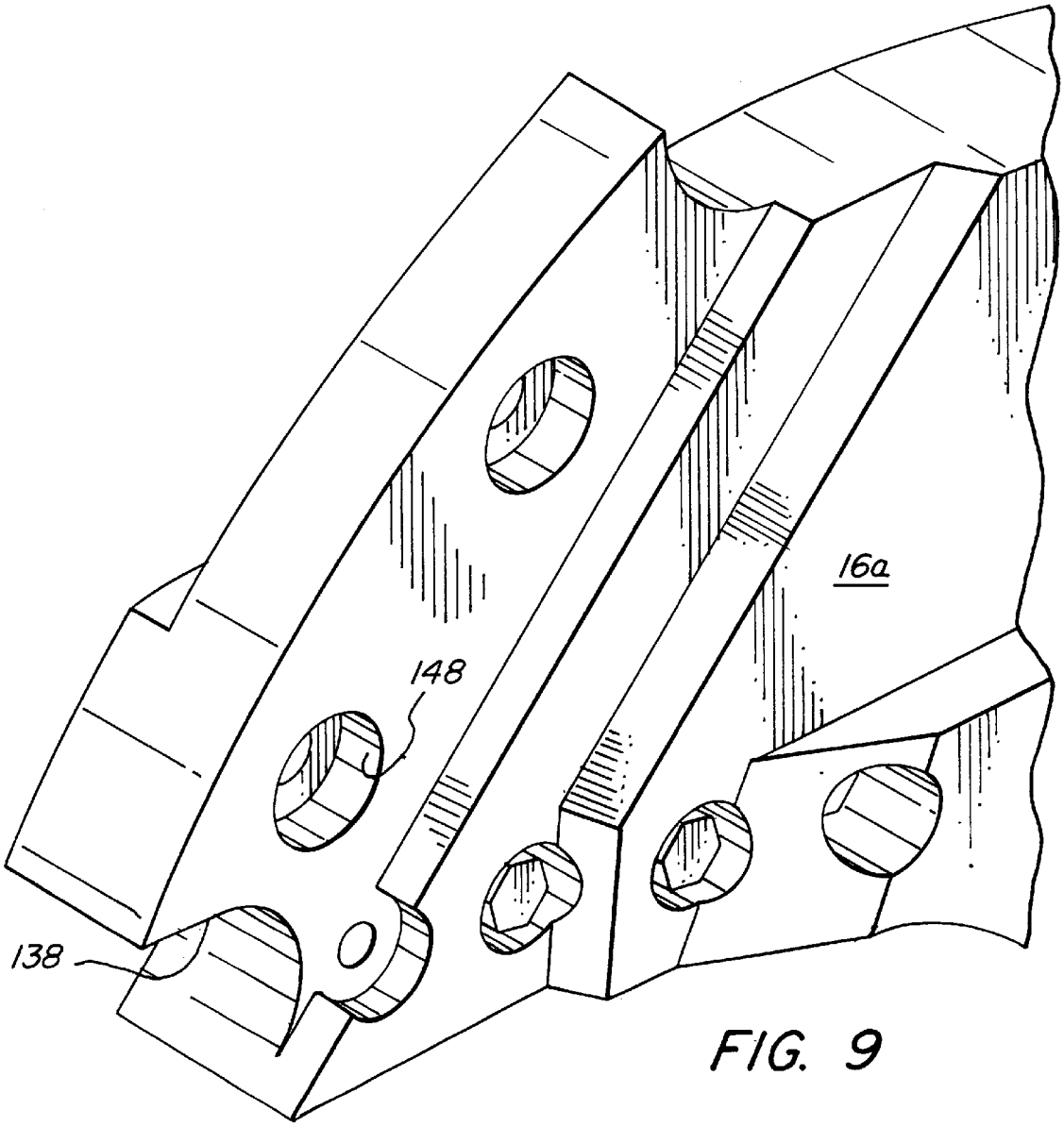
FIG. 9 is an enlarged fragmentary perspective view of the nose end of the upper jaw embodiment seen in FIG. 8 without the wear blade and nose blade.
Figure 10:
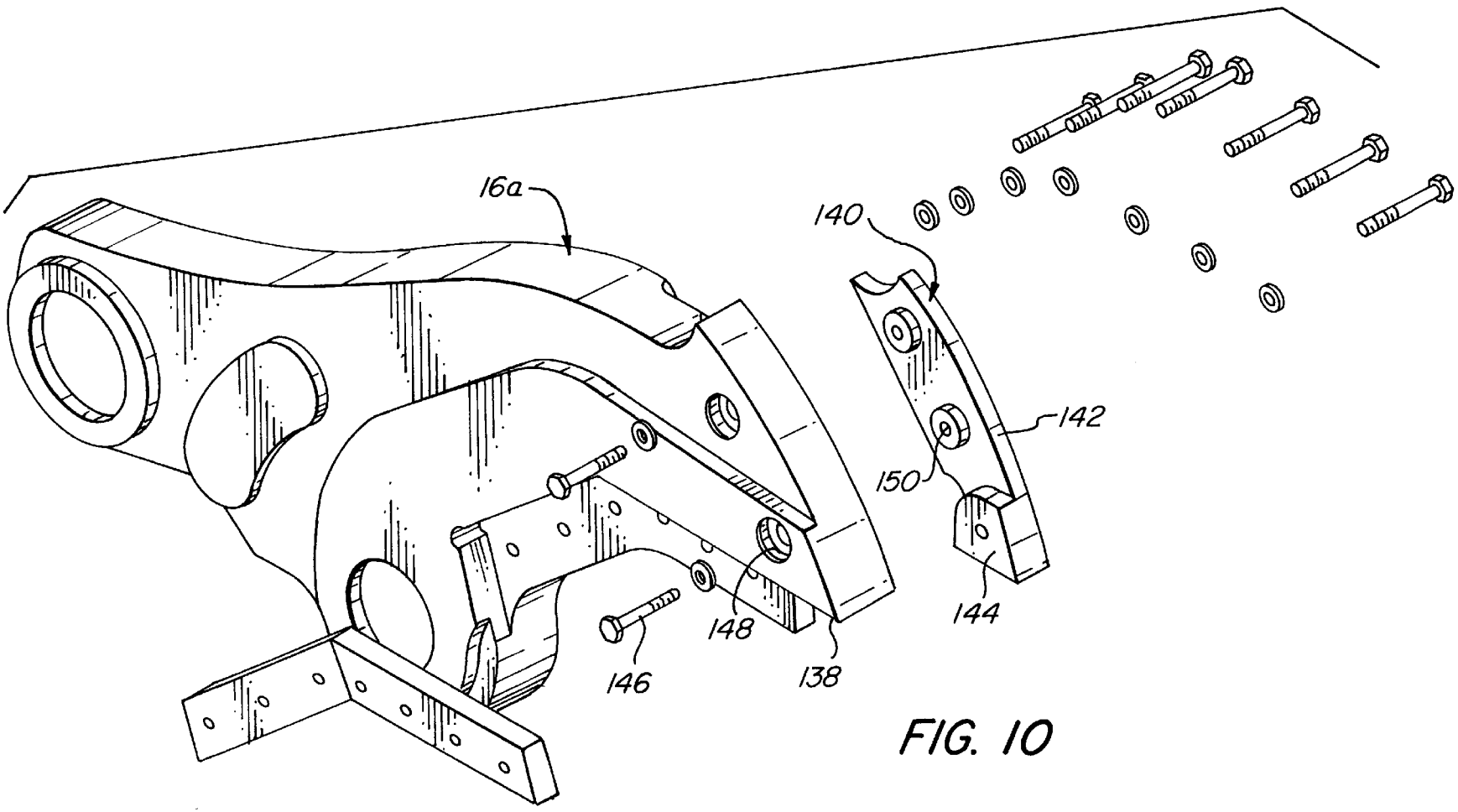
FIG. 10 is an exploded view of the upper jaw embodiment of FIGS. 8 and 9.

Turning now to FIGS. 8–10, therein illustrated is an alternate embodiment of construction for the nose end of the upper jaw. As can be seen, the upper jaw 16*a* has a notched portion 138 at its forward end and the secondary cutter blade 116*a* terminates at the notched portion. In this embodiment, a nose member generally designated by the numeral 140 has an elongated wear plate portion 142 extending along the guide side surface 40*a* of the upper jaw 16 and an integrally formed nose piece 144 at its lower end which seats in the notch 138. The nose member 140 is secured to the upper jaw 16*a* by fasteners 146 extend through apertures 148 in the upper jaw 16*a* and threadably seat in the apertures 150 in the nose member 140.

Figure 11:
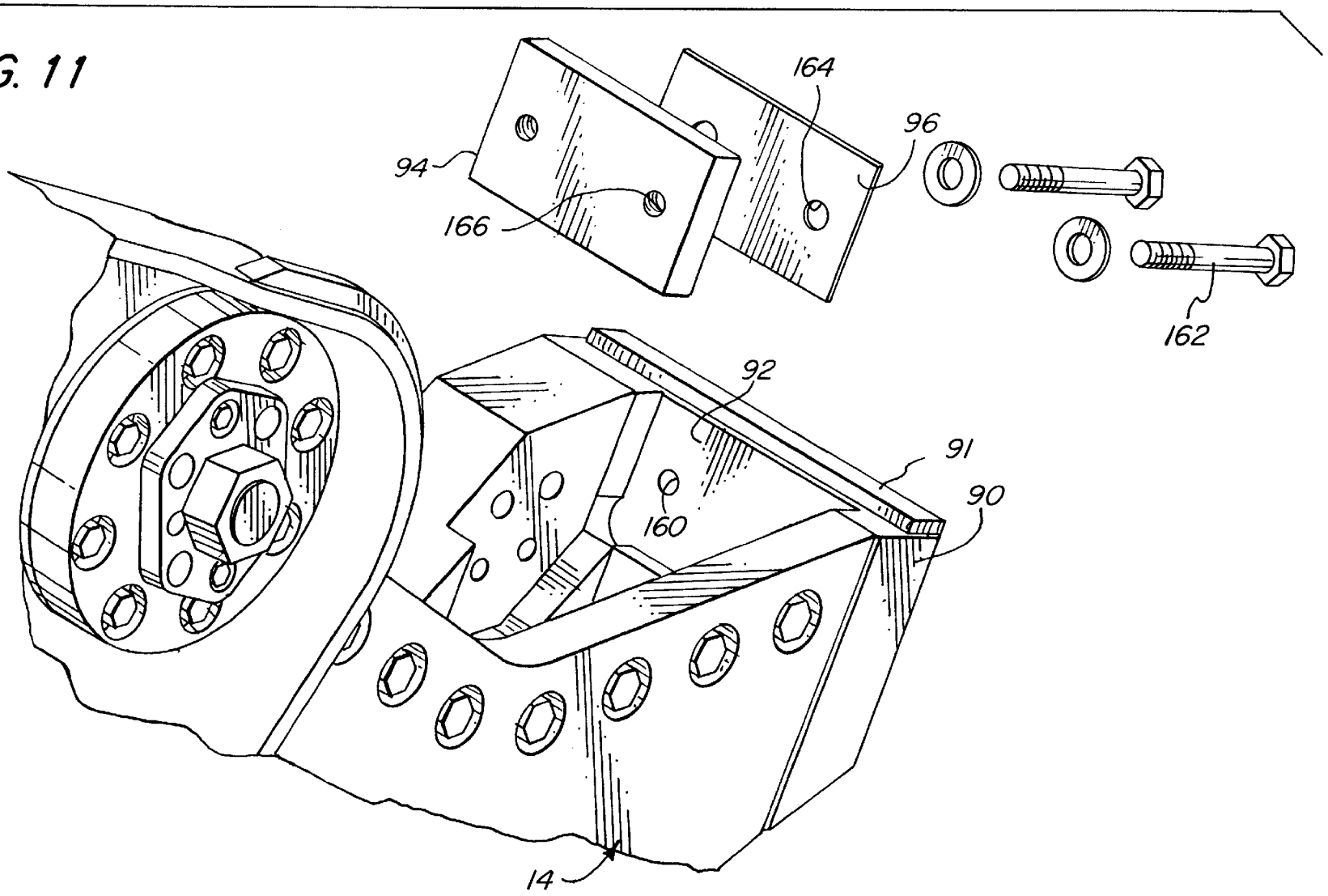
FIG. 11 is an enlarged fragmentary perspective view of the outer end of the lower jaw showing an alternate mounting arrangement for the cross cutter blade.

Turning next to FIG. 11, there is an alternate embodiment for the outer end wall 32*a* to mount the cross cutter blade 94*a*. In this instance, the inner surface of the cross member 90*a* is formed with a rectangular recess 92*a* of rectangular configuration but without the projecting boss of the prior embodiment. The cross cutter blade 94*a* is of rectangular configuration and seats snugly against the shoulders 104*a* defining the recess 92*a*. Extending through the wear member 91*a* and cross member 90*a* are apertures 160, and fasteners 162 extend through the apertures 160 and through the apertures 164 in the shim 96 to threadably seat in the apertures 166 in the cutter blade 94*a*. As in the prior embodiment, the distal ends of the guide blade 80 and secondary cutter blade 66 (not shown in this view) are parallel to the reference plane and abut the surface of the cross cutter blade 94*a* to firmly secure it in position.

Figure 12:
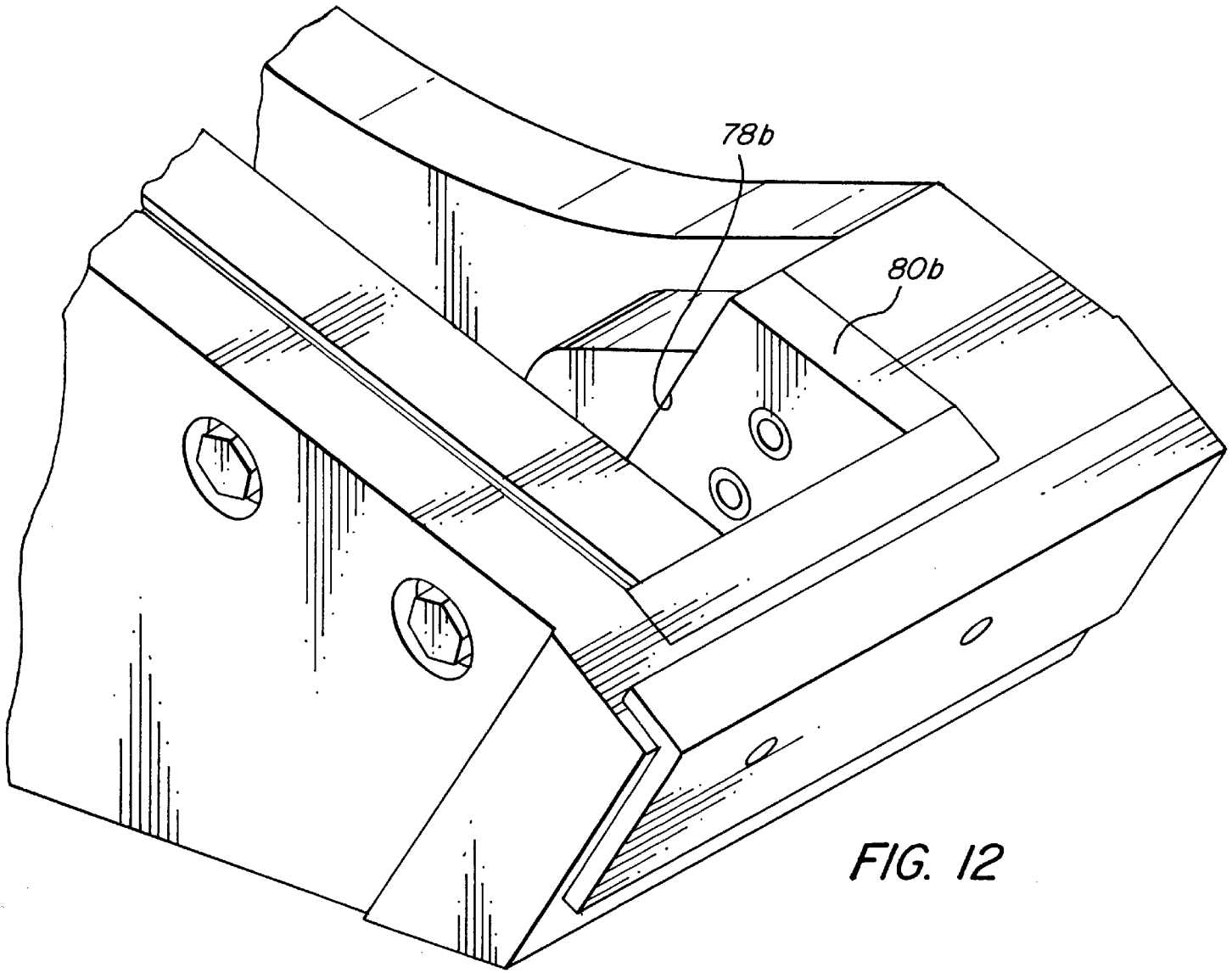
FIG. 12 is an enlarged fragmentary view of the outer end of the lower jaw showing an alternate embodiment for the guide blade.

In FIG. 12, there is illustrated an alternate configuration for the guide blade seating recess 78*b* and guide blade 80*b*. Rather than the hexagonal configuration of the prior embodiment, this recess 78*b* and blade 80*b* are four sided parallelograms with equal sides so that all four edge surfaces may be employed.

Figure 13:
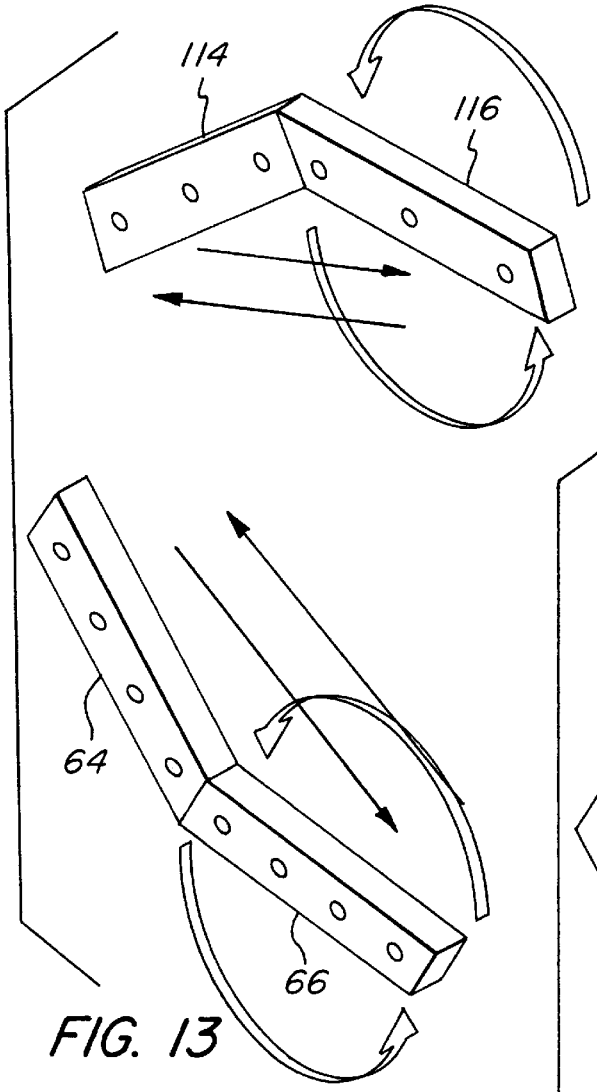
FIGS. 13 and 14 are diagrammatic views showing the manner in which the elongated cutter blades of the upper and lower jaws may be reversed, inverted or exchanged for utilization of all the surfaces.
Figure 14:
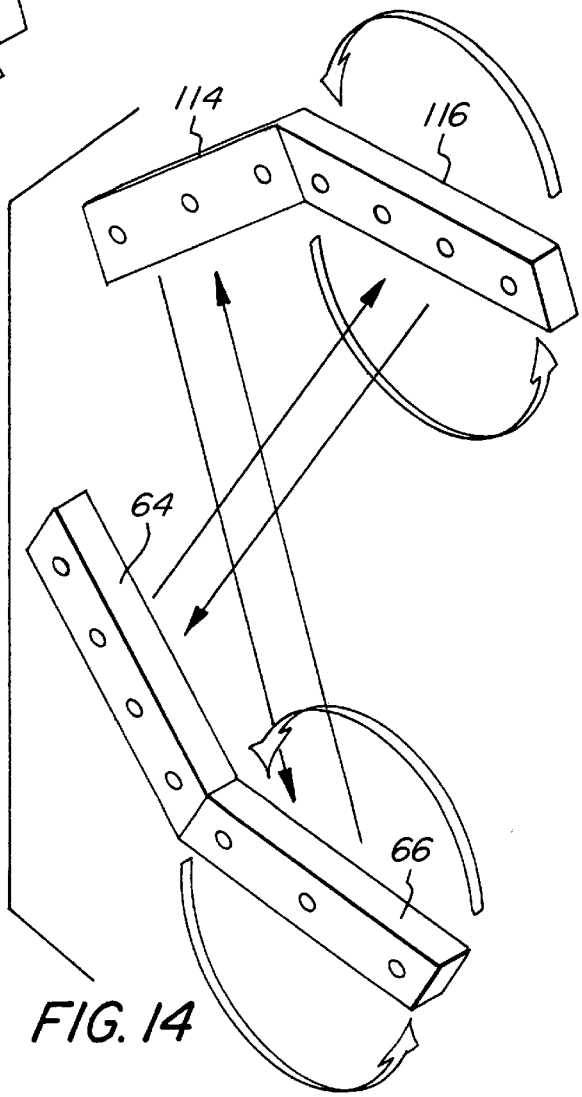

As seen in the embodiment of FIGS. 1–4, the primary and secondary cutter blades of the lower jaw are of equal length. The same is true with respect to primary and secondary blades of the upper jaw except that they are of shorter length than those of the lower jaw. In this embodiment the cutter blades of each jaw may be interchanged one for the other, but not between upper and lower jaws. This is illustrated diagrammatically in FIG. 13 of the drawings. The arrows also indicate that the cutter blades may be rotated. Thus, all four longitudinal edges may be placed in the operative position for the shearing action. However, in some shear embodiments, it may be desirable to have the primary cutting blade on the lower jaw longer than the primary cutting blade of the upper jaw and conversely the secondary cutting blade of the lower jaw shorter than the secondary cutting blade of the upper jaw. In this instance by proper dimensioning of the several cutting blades, the primary blade of the lower jaw can be exchanged with the secondary blade of the upper jaw and the secondary blade of the lower jaw can be exchanged with the primary blade of the upper jaw. This is illustrated in FIG. 14.

In still other instances, all four blades may be of equal length, thus enabling the cutter blades to be interchanged freely on the same jaw or with the blades of the lower jaw in either primary or secondary positions.

Generally the cutter blades and guide blades will be disposed so that their working surfaces are spaced outwardly from the adjacent surfaces of the jaw upon which they are seated so that initial and primary contact with the workpiece by the cutter blades is ensured. However, although less desirable, the working surfaces of the cutter blades may lie in the same plane as the adjacent surfaces of the jaws upon which they are mounted.

In the illustrated embodiment, only the upper jaw is pivotable by a single piston. In some shears where more power is desired in the cutting stoke, both jaws may be movable relative to each other by use of a pair of hydraulic cylinders as, for example, in U.S. Reissue Pat. No. 35,432 reissued Jan. 28, 1997.

Thus, it can be seen from the foregoing detailed description and attached drawings that the demolition shear of the present invention provides substantially continuous wear surfaces over the working surface of the upper and lower jaws so as to minimize wear of the less durable material of the adjacent surfaces of the jaws upon which they are mounted. The cutter blades may be exchanged and rotated as to enable use of all four longitudinal edges thereof as the principal cutting edges. The cutter blades may be quickly and easily disassembled and substituted and can be produced relatively economically.

Having thus described the invention, what is claimed is:

1. A demolition shear having:

(a) elongated upper and lower jaws with opposing faces between which workpieces are received, at least one of said jaws begin movable relative to the other about a pivot, said lower jaw having a pivot portion and an elongated jaw portion extending therefrom, said jaw portion having a cutter side wall, a guide side wall and an outer end wall collectively defining with said pivot portion a generally rectancular recess, said cutter side wall having upper working surface with a generally V-shaped configuration provided by a proximal section adjacent said pivot portion and distal section extending to said outer end wall, aid sections intersecting at an obtuse angle, the inner face of said cutter side wall having a recess formed therealong provding a blade seating shoulder extending longitudinally thereof and parallel to said upper surface of said cutter side wall, said recess in said cutter side wall having a proximal end shoulder adjacent said pivot portion intersecting at an obtuse angle with said blade seating shoulder, said proximal end shoulder defining a specified reference plane;

(b) a pair of elongated lower cutter blades seated on said blade seating shoulder, said blades each having a rhomboidal configuration with the same included angles, said cutter blades having end faces extending in planes parallel to said specified reference plane of said proximal end shoulder of said recess, said cutter blades having closely abutting end surface and a top face extending substantially parallel to the upper surface of said cutter side wall;

(c) releasable fasteners securing said lower cutter blades to said cutter side wall, said cutter blades being reversible to enable usage of all longitudinal edges thereof;

(d) said outer end wall having an inner surface portion extending in a plane parallel to said specified reference plane and a blade seating shoulder on said inner surface portion;

(e) a cross cutter blade seated on said blade seating shoulder of said outer end wall and having end surfaces and proximal and distal side surfaces, said cross cutter blade extending in a plane parallel to said specified referece plane and at an acute angle to the plane of an upper suface of said cutter side wall, said cutter blade on said distal section of said cutter side wall having its end surface bearing against said proximal side surface of said cross cutter blade, (f) the inner surface of said guide side wall having a recess formed therein adjacent said outer end wall providing a blade seating shoulder;

(g) a guide blade seated on said blade seating shoulder of said guide side wall with its distal end surface being parallel to said specified reference plane and bearing firmly against said proximal side surface of said cross cutter blade, the top surface of said guide blade exetending substantially parallel to the adjacent surface of said guide side wall, said cross cutter blade having a slot therein and said shoulder on said outer end wall is seated in said slot;

(h) releasable fasteners securing said guide blade to said guide side wall, said guide blade being reversible to enable usage of plural edges thereof;

(i) said upper jaw having a pivot portion and a jaw portion extending therefrom, said jaw portion having a cutter side surface adjacent said cutter side wall of said lower jaw and a guide side surface adjacent said guide side wall of said lower jaw, said jaw portion of said upper jaw having a lower working surface of inverted V-shaped configuration provided by a proximal section adjacent said pivot portion and a distal section spaced therefrom, said sections intersecting at an obtuse angle, said cutter side surface of said jaw portion of said upper jaw having a recess formed therein providing a blade seating shoulder extending longitudinally thereof, said upper jaw having a nose portion at its distal end;

(j) a pair of elongated upper cutter blades bearing against said blade seating shoulder of said upper jaw and having a lower face extending parallel to the lower working surface, said upper cutter blades of said upper jaw having end surfaces extending in planes parallel to said reference plane and abutting closely; and (k) releasable fastener securing said upper cutter blades to said upper jaw, said upper jaw portion being dimensioned cooperatively with said rectangular recess of said lower jaw so as to be movable thereinto, said upper and lower cutter blades adjacent said pivot portions of said jaws being the primary blades, said upper and lower cutter blader, adjacent said distal sections of said jaws being the secondary blades, said nose portion of said upper jaw being spaced from said cross cutter blade as said upper jaw moves into said rectangular recess.

2. The demolition shear in accordance with claim 1 wherein said shoulder on said outer end wall is provided by an inwardly projecting boss dimensioned to seat in said slot of said cross cutter blade.

3. A demolition shear having:

(a) elongated upper and lower jaws with opposing faces between which workpieces are received, at least one of said jaws being movable relative to the other about a pivot, said lower jaw having a pivot portion and an elongated jaw portion extending therefrom, said jaw portion having a cuter side wall, a guide side wall and an outer end wall collectively defining with said pivot portion a geterally rectangular recess, said cutter side wall having an upper working surface with a generally V-shaped configuration provided by a proxital section adjacent said pivot portion and a distal section etending to said outer end wall, said sections intersecting at an obtuse angle, the inner face of said cutter side wall having a recess foxed therealong providing a blade seating shoulder extending longitudinally thereof and parallel to said upper surface of said cutter side wall, said recess in said cutter side wall having a proximal end shoulder adjacent said pivot portion intersecting at an obtuse angle with said blade seating shoulder, said proxital end shoulder defining a specified reference plane;

(b) a pair of elongated lower cutter blades seated on said blade seating shoulder, said blades each having a rhomboidal configuration with the same included angles, said cutter blades having end faces extending in planes parallel to said specified reference plane of said proximal end shoulder of said recess, said cutt blades having clogely abutting end surfaces and a top face extending substantially parallel to the upper surface of said cutter side wall;

(c) releasable fasteners securing said lower cutter blades to said cutter side wall, said cutter blades being reversible to enable usage of all longitudinal edges thereof;

(d) said outer end wall having an inner surface portion extending in a plane parallel to said specified reference plane and a blade seating shoulder on said inner surface portion;

(e) a cross cutter blade seated on said blade seating shoulder of said outer end wall and having end surfaces proximal and distalsde surfaces, said cross cutter blade extending in a plane parallel to said specified reference plane and at an acute angle to the plane of an upper surface of said cutter side wall, said cutter blade on said distal section of said cutter side wall having its end surface bearing against said proximal side surface of said cross cutter blade;

(f) the inner surface of said guide side wall having a recess formed therein adjacent said outer end wall providing a blade seating shoulder;

(g) a guide blade seated on said blade seating shoulder of said guide side wall with its distal end surface being parallel to said specified reference plane and bearing firmly against said proxinal side surface of said cross cutter blade, the top surface of said guide blade extending substantially parallel to the adjacent surface of said guide side wall;

(h) releasable fasteners securing said guide blade to said guide side wall, said guide blade being reversible to enable usage of plural edges thereof;

(i) said upper jaw having a pivot portion and a jaw portion extending therefrom, said jaw portion having a cutter side surface adjacent said cutter side wall of said lower jaw and a guide side surface adjacent said guide side wall of said lower jaw, said jaw portion of said upper jaw having a lower working surface of inverted V-shaped configuration provided by a proximal section adjacent said pivot portion and a distal section spaced therefrom, said sections intersecting at an obtuse angle, said cutter side surface of said jaw portion of said upper jaw having a recess formed therein providing a blade seating shoulder extending longitudinally thereof, said upper jaw having a nose portion at its distal end;

(j) a pair of elongated upper cutter blades bearing against said blade seating shoulder of said upper jaw and having a lower face extending parallel to the lower working surface, said upper cutter blades of said upper jaw having end surfaces extending in planes parallel to said reference plane and abutting closely; and (k) releasable fasteners securing said upper cutter blades to said upper jaw, said upper jaw portion being dimensioned cooperatively with said rectangular recess of said lower jaw so as to be movable thereinto, said upper and lower cutter blades adjacent said pivot portions of said jaws being the primary blades, said upper and lower cutter blades adjacent said distal sections of said jaws being the secondary blades, said nose portion of said upper jaw being spaced from said cross cutter blade as said upper jaw moves into said rectansmlar recess.

4. The demolition shear in accordance with claim 3 wherein said recess of said upper jaw has an end shoulder at its proxixal end which intersects said blade seating shoulder of said upper jaw at an obtuse included angle corresponding to said angle between said blade seating and proximal end shoulders of said lower jaw.

5. The demolition shear in accordance with claim 3 wherein said upper cutter blades have a rhomboidal configuration corresponding to that of said lower cutter blades.

6. The demolition shear in accordance with claim 5 wherein said upper cutter blades are equal in dimension to said lower cutter blades.

7. The demolition shear in accordance with claim 6 wherein said lower and upper cutter blades are reversible and may be interchanged to enable all four longitudinal edges thereof to be employed as cutting edges.

8. The demolition shear in accordance with claim 5 wherein said upper primary and secondary cutter blades are of the same dimension and wherein said lower primary and secondary cutter blades are of the same dimension, but differ in length from said upper blades, whereby said cutter blades of each of said jaws may be interchanged.

9. The demolition shear in accordance with claim 5 wherein said primary upper and secondary lower cutter blades are of the same dimensions and said secondary upper and primary lower cutter blades are of the same dimensions but of different length than the length of said primary upper and secondary lower cutter blades whereby said primary cutter blade of one jaw may be interchanged with the secondary blade of the other cutter jaw.

10. The demolition shear in accordance with claim 9 wherein said guide blade is of hexagonal configuration to enable said guide blade to be rotated and inverted to use a multiplicity of the edges thereof for contact with workpieces and support of said upper jaw.

11. The demolition shear in accordance with claim 3 wherein said guide blade has a multiplicity of edge surfaces intersecting at included angles substantially equal to the included angle of said rhomboidal configuration of said lower and upper cutter blades, one of said edge surfaces extending parallel to the upper surface of said guide side wall.

12. The demolition shear in accordance with claim 3 wherein said secondary upper cutter blade extends to the distal end of said upper jaw.

13. The demolition shear in accordance with claim 3 wherein said releasable fasteners have heads and shanks, said heads being seated in recesses in said jaw portions and said shanks engaging said cutter blades.

14. The demolition shear in accordance with claim 13 wherein said lower and upper cutter blades have threaded apertures therein in which said shanks of said fasteners are threadably engaged.

15. The demolition shear in accordance with claim 3 wherein said upper secondary cutter blade is spaced from the distal end of said upper jaw portion and an end cutter member is secured to a lower surface of said distal end of said upper jaw portion to provide a cutting edge surface at said distal end cooperating with said cross cutter blade.

* * * * *

UNITED STATES PATENT AND TRADEMARK OFFICE

CERTIFICATE OF CORRECTION

PATENT NO. : 5,992,023

DATED : November 30, 1999

INVENTOR(S) : Clayton Sederberg, Daniel Jacobson

It is certified that error appears in the above-indentified patent and that said Letters Patent is hereby corrected as shown below:

Column 8, line 16, "aid" should be "said".

Column 9, line 24, "blader" should be "blades"
line 39, "cuter" should be "cutter"
line 41, "geterally" should be "generally"
line 43, "proxital" should be "proximal"
line 44, "etending" should be "extending"
line 47, "foxed" should be "formed"
line 53, "proxital" should be "proximal"
line 60, "cutt" should be "cutter"
line 61, "Clogely" should be "closely"

Column 10, line 7, "distalsde" should be "distal side"
line 20, "proxinal" should be "proximal"
line 55, "rectansmlar" should be "rectangular"

Signed and Sealed this

Thirtieth Day of May, 2000

*Attest:*

Q. TODD DICKINSON

*Attesting Officer*

*Director of Patents and Trademarks*